US005681639A

United States Patent [19]

Minagawa et al.

[11] Patent Number: 5,681,639

[45] Date of Patent: Oct. 28, 1997

[54] WATERPROOF LIGHTWEIGHT GRAIN-TONE DECORATIVE PANEL

[75] Inventors: Mitsuo Minagawa; Osamu Minagawa, both of Komagane, Japan

[73] Assignee: Revall Co., Ltd., Komagane, Japan

[21] Appl. No.: 524,584

[22] Filed: Sep. 8, 1995

[30] Foreign Application Priority Data

Sep. 21, 1994 [JP] Japan ..... 6-013266 U
Jan. 17, 1995 [JP] Japan ..... 7-000972 U

[51] Int. Cl.[6] ..... B32B 5/30

[52] U.S. Cl. ..... 428/143; 428/149; 428/150; 428/324; 428/325; 428/156

[58] Field of Search ..... 428/143, 149, 428/150, 324, 325, 156

[56] References Cited

U.S. PATENT DOCUMENTS 4,689,358 8/1987 Schorr et al. ..... 523/209
4,867,935 9/1989 Morrison, Jr. ..... 264/61

*Primary Examiner*—William Watkins
*Attorney, Agent, or Firm*—Larson & Taylor

[57] ABSTRACT

In the waterproof lightweight grain-tone decorative panel of the present invention, a waterproof grain-tone paint layer is formed on the surface of a lightweight board such as a plastic foaming board and the like. In the layer, a micro-hollow fine ceramic particle of a waterproof pressure strength of 600 kgf/cm$^2$ or more and a crushed natural stone particle are bound with a synthetic resin waterproof binder.

3 Claims, 5 Drawing Sheets

WATERPROOF LIGHTWEIGHT GRAIN-TONE DECORATIVE PANEL

BACKGROUND OF THE INVENTION

1. Field of the Invention

The present invention relates to a readily attachable waterproof lightweight grain-tone decorative panel of a light weight with excellent appearance and a grain tone, which is used as the decorative material of wall surface, pillar, gate, fence, etc. of buildings.

1. Description of the Prior Art

As grain-tone paint materials capable of developing a grain tone on wall surface and the like, it has been known a product produced by kneading a powdery natural stone with a colored powdery mica together with a synthetic resin emulsion adhesive as a binder; or a product produced by kneading a colored particle aggregate produced by spreading an inorganic powder on the surface of an inorganic granule or an organic granule, with a colored flake mica together with a synthetic resin emulsion adhesive.

However, it has been difficult to uniformly coat a paint material containing a colored powdery mica or a colored flake mica on a board for lightweight decorative panel, so such coating requires tough skill.

Additionally, as such paint material, it has been known a mixture produced by kneading together a colored particle such as serpentine and fluorite, a photo-transmissible aggregate particle and an inorganic or organic binder (a binder to form a transparent film after drying).

As has been described above, conventional grain-tone paint materials have been produced by kneading a variety of combinations of natural stone in powder, crushed particles from natural stone, colored particles, mica, calcium carbonate and the like with an inorganic or organic binder.

However, the conventional grain-tone paint materials thus produced lack the smoothness and fluidity required for paint materials, so the workability thereof at application is poor; additionally, the resulting surface is readily damaged because of the low degree of surface hardness.

To some of the conventional grain-tone paint materials has been added calcium carbonate so as to develop grain-tone white color, but these materials have a drawback in that the resulting wall surface is so weak in acids that the surface is eroded with acid rain (rain contaminated with a trace amount of acid substances suspended in atmosphere).

Because such conventional grain-tone paint materials generally have a specific gravity of about 2.2 to 2.3, these have drawbacks such as greater sagging during coating and molding and larger shrinkage during drying.

Since the conventional grain-tone paint materials have such various disadvantages, it has been very difficult to develop the excellent hand and feel and the excellent coloring, specific to natural stone, on the resulting wall surface and the like.

SUMMARY OF THE INVENTION

So as to overcome the disadvantages of the conventional waterproof lightweight grain-tone decorative panels with a grain tone developed thereon, the present invention has been carried out. Thus, the present invention is to provide a readily attachable waterproof lightweight grain-tone decorative panel of a light weight with excellent appearance and a grain tone, which is used as the decorative material of wall surface, pillar, gate, fence, etc. of buildings.

Furthermore, the present invention is to provide a readily attachable waterproof lightweight grain-tone decorative panel of a light weight with the same optical brightness and gloss as those of a marble tone, the decorative panel being readily produced and having excellent weathering resistance.

BRIEF DESCRIPTION OF THE DRAWINGS

For describing the fundamental structure of the readily attachable waterproof lightweight grain-tone decorative panel of the present invention, the figures show the application examples thereof.

DESCRIPTION OF THE PREFERRED EMBODIMENTS

The waterproof lightweight grain-tone decorative panel of the present invention has been achieved in such circumstances. The panel is produced by coating a paint material comprising a synthetic resin waterproof binder of a synthetic resin emulsion, a micro-hollow fine ceramic particle of a waterproof pressure strength of 600 kgf/cm$^2$ or more as a filler and a crushed natural stone particle as a filler onto a base material of any lightweight board selected from a plastic board, a foaming plastic board, a mineral lightweight board, a wood board and the like.

In accordance with the present invention, furthermore, the coated surface may be finally finished into a marble tone with smoothness and optical brightness, by molding the coated surface by pressure press molding or pressure roller molding and thereafter coating a transparent topcoat thereon.

Figure 1:
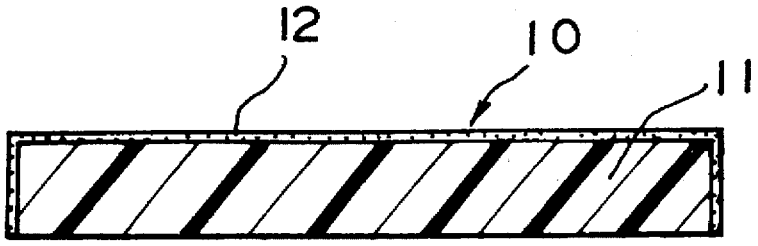
FIG. 1 is a cross-sectional view depicting a waterproof lightweight grain-tone decorative panel wherein the surface of a lightweight board cut into the shape and dimension of a tile is covered with a waterproof grain-tone paint layer.

The fundamental structure of the waterproof lightweight grain-tone decorative panel in accordance with the present invention is shown as in FIG. 1, wherein waterproof lightweight grain-tone decorative panel 10 is composed of lightweight board 11 and waterproof grain-tone paint layer 12 formed on the surface thereof.

Herein, the lightweight board 11 as the base material is any one of a plastic board, a foaming plastic board, a mineral lightweight board, a wood board and the like. The lightweight board 11 is cut into the shape and dimension of a tile for use, but the shape and dimension thereof is not limited to a specific shape and a specific dimension; for example, the shape (observed from above) may be square, rectangle, triangle, circle and another shape from various shapes; and the dimension may be a small size of a mosaic tile to a large size of a large tile of 1 m or larger. The side shape of the lightweight board is plane.

The thickness of the lightweight board 11 is 2 to 20 mm, preferably 3 to 6 mm in particular.

The raw material of the lightweight board 11 should be of a light weight, preferably with a specific gravity of 1.0 or less, and more preferably with a specific gravity of 0.4 or less. As has been described above, the lightweight board as the base material is a plastic board, a foaming plastic board, a mineral lightweight board, a wood board and the like. These will be described hereinbelow. Firstly, the raw material of a plastic board may be any type of plastics which can be extrusion molded, and preferably, use may be made of polyvinyl chloride, polyethylene, polypropylene, acrylonitrile butadiene styrene resin and the like.

The raw material of a foaming plastic board may be any type of plastics which can be extrusion molded or bead molded (molded by expandable beads); and use may be made of polystyrene foam, polyurethane foam, polyvinyl chloride foam, polyvinylidene chloride foam, phenol foam, polyisocyanurate foam and the like.

As the raw material of a mineral lightweight board, use may be made of mineral foams such as cement mixed with a lightweight aggregate, foaming cement, lightweight aerated concrete, foaming glass, ceramic foam, lightweight aggregate bound foam, etc.; materials bound with mineral fiber such as rockwool, glass wool, etc.; and mineral raw materials such as calcium silicate, magnesium carbonate, etc.

As the wood board, use may be made of natural wood board, wood fiber board bound with a binder, chipboard, cement chipboard, artificial wood board and the like.

The waterproof grain-tone paint layer 12 formed on the surface of lightweight board 11 is formed by coating a paint material on the surface of the board 11, and the paint material is principally composed of a synthetic resin waterproof binder, a micro-hollow fine ceramic particle and a crushed natural stone particle, as described below.

The synthetic resin waterproof binder as the component of the paint material described above includes synthetic resin emulsions such as acrylic resin emulsion; vinyl acetate resin emulsion; vinyl chloride resin emulsion; vinylidene chloride resin emulsion; styrene/butadiene resin emulsion; epoxy resin emulsion; and copolymer emulsions of acrylate with styrene, ethylene, vinyl ester, vinyl acetate, vinylidene acetate, synthetic rubber, a monomer for forming synthetic rubber, and the like.

These copolymers include, for example, acrylate/vinyl acetate copolymer, vinylidene chloride/butyl acrylate copolymer, ethylene/vinyl acetate copolymer and the like.

The strength of the micro-hollow fine ceramic particle as another component of the paint material should have a waterproof pressure strength of 600 kgf/cm$^2$ or more. The waterproof pressure strength herein referred to may be measured as follows; charging the micro-hollow fine ceramic particle into water, and adding a pressure to water to compress the micro-hollow fine ceramic particle with the pressure loaded on water, the pressure at the upper limit should be measured and designated as such.

The micro-hollow fine ceramic particle comprises an aluminosilicate fine ceramic particle composed of 35 to 45% by weight of alumina components and 55 to 65% by weight of silica components, as well as 3% or less, preferably 1.5% or less by weight of other components. The micro-hollow fine ceramic particle is produced by heating and foaming the fine ceramic particle. Because of the lower content of the other components, the micro-hollow fine ceramic particle has a melting point of 1500° C. or more and a waterproof pressure strength above 600 kgf/cm$^2$.

When the micro-hollow fine ceramic particle has a low waterproof pressure strength, the particle is mostly broken during the process of kneading the raw materials, so that the intended objectives cannot be achieved. Conventional inorganic micro-hollow foams include shirasu balloon, glass balloon, silica balloon and the like, but these foams cannot satisfy the objectives of the present invention because the waterproof pressure strength of shirasu balloon is as small as 80 kgf/cm$^2$ while those of glass balloon and silica balloon are about 150 to 200 kgf/cm$^2$.

By using a micro-hollow fine ceramic particle of a waterproof pressure strength of 600 kgf/cm$^2$ or more in accordance with the present invention, the particle is not at all broken during the process of kneading the raw materials of the paint material, or during the process of coating, or during pressure press molding or pressure roller molding if necessary after coating or during the employment of the decorative panel. Therefore, it cannot be observed any decrease in the volume of the paint material by such damage or any change of the compositions due to the broken particles.

For use, the micro-hollow fine ceramic particle may be in a range of 20 to 350 μm. Then, the particle can be adjusted to have an appropriate particle size distribution such as fine particles of 12 to 75 μm and coarse particles of 50 to 350 μm prior to mixing for use. Because the micro-hollow fine ceramic particle with a fine particle size is of a heavier weight while the particle with a coarse particle size is of a lighter weight, the bulk density will be in range of 0.3 to 0.5 g/cm$^2$. The micro-hollow fine ceramic particle should be used in a range of 15 to 40% by weight. Below 15% by weight or less, the particle cannot bring about satisfactory gloss and optical brightness of a grain tone; above 40% by weight, the viscosity of the paint material is low.

The crushed natural stone particle as the other component of the paint material includes one or more of crushed natural stones such as granite, andesite, marble, serpentine and the like. The degree of crushing, fine, medium and coarse, can be adjusted to fine, medium and coarse particle sizes of 0.1 to 0.5 mm, 0.5 to 1.5 mm and 1.5 to 3.4 mm, respectively.

Other than such crushed natural stone particles, there may be added quartz sand, quartz rock powder, fly ash powder, silica fume, clay, talc, kaolin, crushed matters of ceramics, annealed furnace slug ground matters, silica dust and the like.

So as to improve the properties of the paint material of the present invention if necessary, there may be furthermore added other than those described above, various surfactants as dispersion agents, emulsifiers to stabilize emulsion, foaming preventing agents of emulsion, thickeners, sagging preventing agents, sedimentation preventing agents, anti-freezing agents and the like.

For the purpose of improving the properties of the paint layer, furthermore, there may be added a plasticizer giving flexibility to the paint layer, a stabilizer to prevent the deterioration via heat and light, a mildew proofing agent to prevent the occurrence of moldiness and the like.

Preferably, the composition of the paint material to be used herein is composed of 10 to 35% by weight of a micro-hollow fine ceramic particle of a waterproof pressure strength above 600 kgf/cm$^2$, 30 to 65% by weight of the crushed natural stone particle, and 10 to 30% by weight of a synthetic resin waterproof binder emulsion. Diluting water may be added at 0 to 20% by weight of the total weight.

The paint material of the present invention is produced by kneading together the aforementioned micro-hollow fine ceramic particle, the crushed natural stone particle and the synthetic resin waterproof binder emulsion, and by coating and drying the material on the surface of the lightweight board 11, waterproof grain-tone paint layer 12 is formed thereon.

Preferably, the composition of the resulting waterproof grain-tone paint layer 12 is 15 to 40% by weight of a micro-hollow fine ceramic particle of a waterproof pressure strength above 600 kgf/cm$^2$, 35 to 70% by weight of the crushed natural stone particle and 5 to 20% by weight of the waterproof binder.

Figure 2:
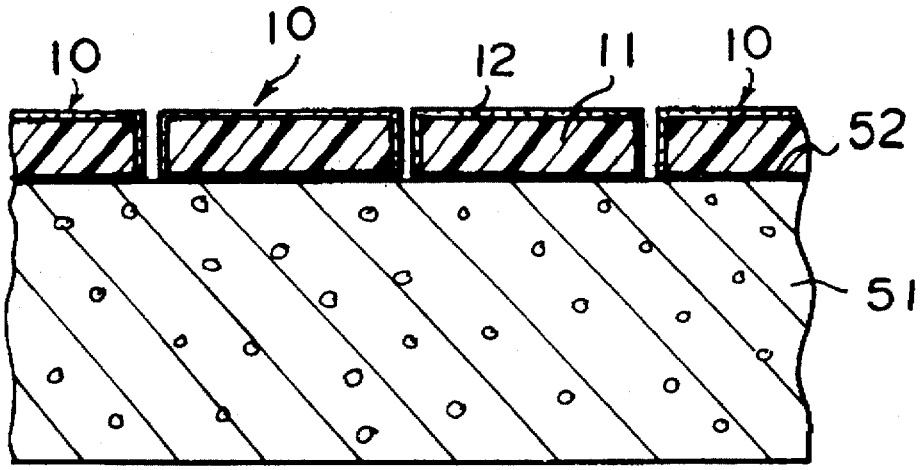
FIG. 2 is a cross-sectional view depicting the waterproof lightweight grain-tone decorative panel, shown in FIG. 1, which is attached and spread onto a structural base (including a base panel) with an adhesive.

As shown in FIG. 2, the waterproof lightweight grain-tone decorative panel 10, shown in FIG. 1, is attached and spread onto concrete structure 51 for example with adhesive 52.

The waterproof lightweight grain-tone decorative panel 10 of the present invention can realize a decorative panel of a light weight which cannot be achieved by prior art, so that the panel can be readily applied. The paint material to be coated onto the lightweight board has such an excellent fluidity that the material can achieve excellent smoothness. Even an unskilled person can readily manage the coating thereof because the material does not cause sagging or does not cause unevenness in coating. Because the structure applied with the waterproof lightweight grain-tone decorative panel 10 of the present invention has great thermal insulation properties, the structure can prevent the elevation of the interior temperature due to the transmission of solar heat during summer season. The waterproof lightweight grain-tone decorative panel 1G has a high surface hardness so that the structure is hardly damaged. A micro-hollow fine ceramic particle of a smaller particle size is nearly pure white, so the particle can represent the whitening tone of a grain tone. Additionally, the panel has excellent durability against acids.

Figure 3:
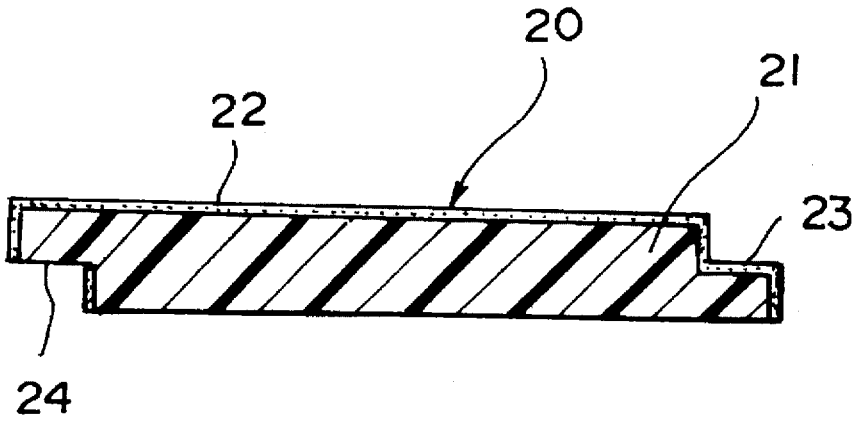
FIG. 3 is a cross-sectional view depicting a waterproof lightweight grain-tone decorative panel where both the ends of a lightweight board cut into the shape and dimension of a tile are partially cut out to make half-lap joints.

FIG. 3 then depicts waterproof lightweight grain-tone decorative panel 20 similar to the waterproof lightweight grain-tone decorative panel 10, except that level difference parts 23, 24 are formed at the upper half of one end and the bottom half of the other end of the panel 20.

Figure 4:
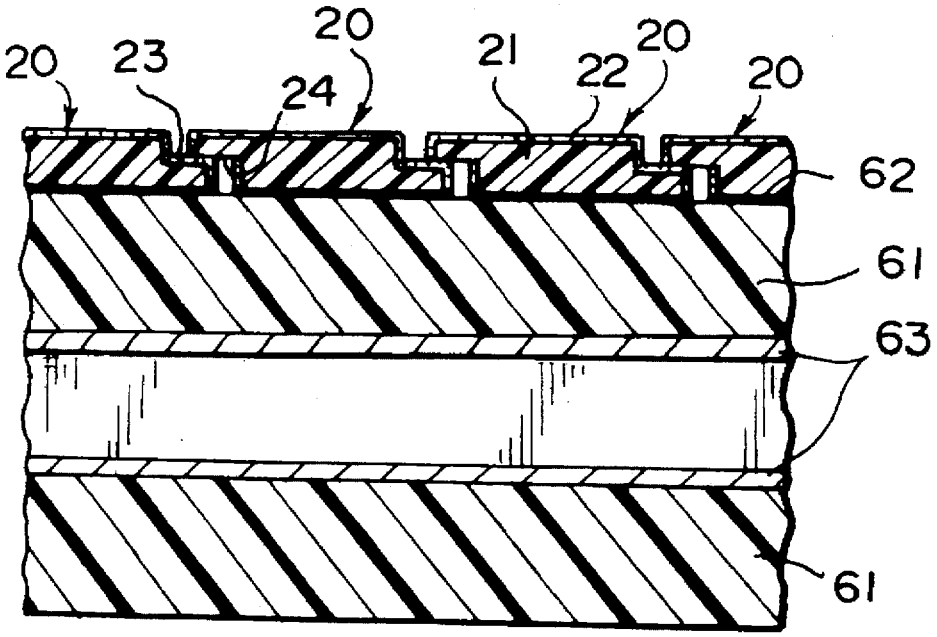
FIG. 4 is a cross-sectional view depicting the waterproof lightweight grain-tone decorative panel with the half-lap joints, shown in FIG. 3, which is attached and spread onto a structural base (including a base panel) with an adhesive.

As shown in FIG. 4, furthermore, the waterproof lightweight grain-tone decorative panel 20 may be attached and spread onto foaming plastic structure 61 with adhesive 62. The foaming plastic structure 61 is made of aluminum structure 63 with coated surface. The structure for attachment and spreading may be any one of a metal material, an inorganic material, an organic material and a wood material.

Figure 5:
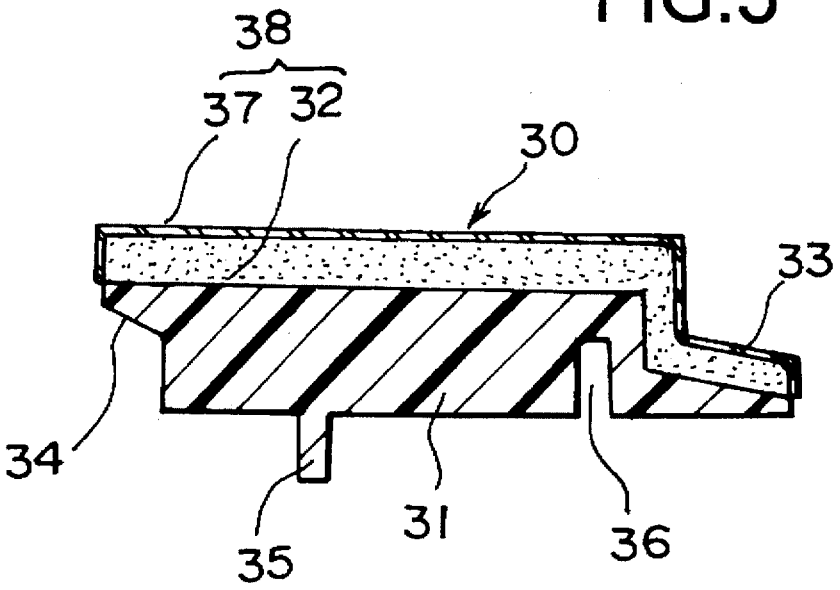
FIG. 5 is a cross-sectional view depicting a marble-tone decorative panel where the surface of a lightweight board cut into the shape and dimension of a tile is covered with a marble-tone paint layer and the back surface thereof has a narrow attachment projection and a narrow attachment slot formed thereon.

FIG. 5 depicts marble-tone decorative panel 30 produced by forming marble-tone paint layer 38 onto the surface of the lightweight board 31 with level difference parts 33, 34 formed at the upper half of one end and the bottom half of the other end thereof.

The lightweight board 31 to be used therefor is the same as the lightweight board in FIGS. 1 and 3. The marble-tone paint layer 38 is produced by subjecting the dried surface of the waterproof lightweight grain-tone paint layer 32 which is the same as the waterproof grain-tone paint layer as in FIGS. 1 and 3 to pressure press molding or pressure roller molding and subsequently forming topcoat layer 37 on the resulting surface.

By controlling the pressure via press or roller within a range of 50 to 500 kgf/cm$^2$, the gloss and optical brightness of a marble tone can be realized on the paint layer 38. Below 50 kgf/cm$^2$, satisfactory marble tone cannot be brought about; above 500 kgf/cm$^2$, slight distortion may develop in the paint layer.

The topcoat layer 37 may be composed of any transparent synthetic resin layer of great weathering resistance and gloss; and a topcoat layer formed by coating a synthetic resin emulsion used above as the synthetic resin waterproof binder emulsion is particularly excellent in terms of adhesion to the paint layer 32. Due to the presence of the topcoat layer 37, the improvement of weathering resistance and the protection of the paint layer 32 can be done, further developing excellent marble-tone gloss and optical brightness.

In the waterproof lightweight marble-tone decorative panel 30 thus produced, the micro-hollow fine ceramic particle is not at all broken by pressure press molding or pressure roller molding, which together with the crushed natural stone particle can enhance the hardness and impact strength of the paint film. The crushed natural stone particle and the micro-hollow fine ceramic particle are uniformly dispersed on the surface of the waterproof lightweight marble-tone decorative panel 30, exerting excellent gloss and optical brightness. The micro-hollow fine ceramic particle in particular has such a small particle size that the appearance thereof is transparent or semi-transparent, and the particle can get enhanced gloss by pressure press molding or pressure roller molding. Therefore, the micro-hollow fine ceramic particle exerts exceedingly great gloss and brightness by reflecting illuminated light. Via the synergistic effect with the crushed natural stone particle with gloss enhanced by pressure press molding or pressure roller molding, the fine ceramic particle represents gloss and color tone as if they were those of marble.

Figure 6:
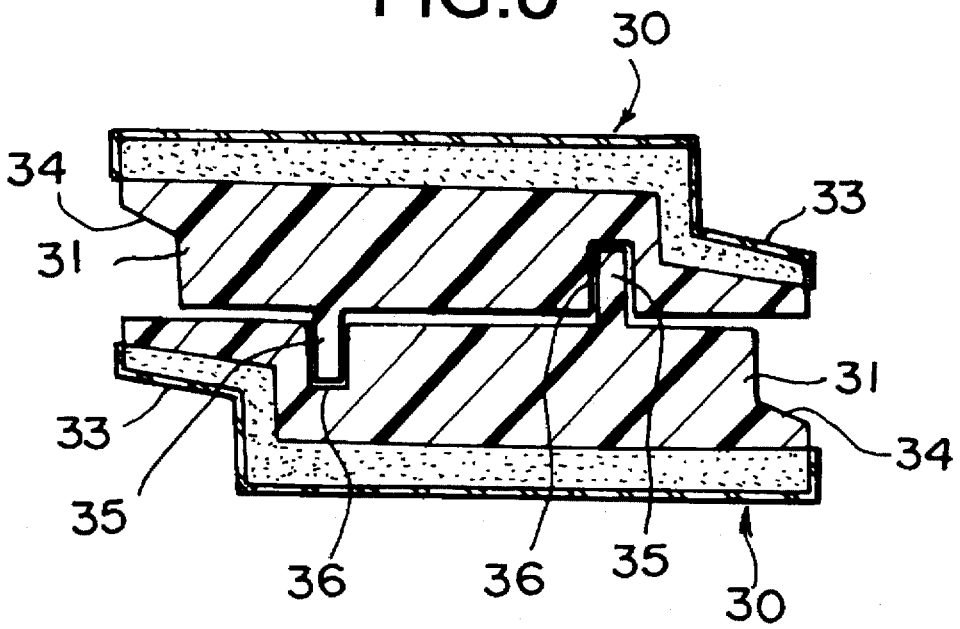
FIG. 6 is a cross-sectional view depicting the marble-tone decorative panel of FIG. 5 during transfer.

In FIG. 5, narrow attachment projection 35 and narrow attachment slot 36 are formed on the back surface of the lightweight board 31 so as to readily and precisely promote the application of the decorative panel. As shown in FIG. 6, the back surfaces of these waterproof lightweight marble-tone decorative panels can overlap each other by placing the narrow attachment projection 35 into the narrow attachment slot 36, during the transfer of these decorative panels. Thus, the inconvenience of the handling of these panels due to the formation of the narrow attachment projection 35 can be eliminated completely.

The narrow attachment projection 35 or the narrow attachment slot 36 formed on the back surface of the lightweight board 31 of the waterproof lightweight marble-tone decorative panel 30 promotes the application of the waterproof lightweight marble-tone decorative panel 30 advantageously, so even an unskilled person can easily operate the panel.

Figure 7:
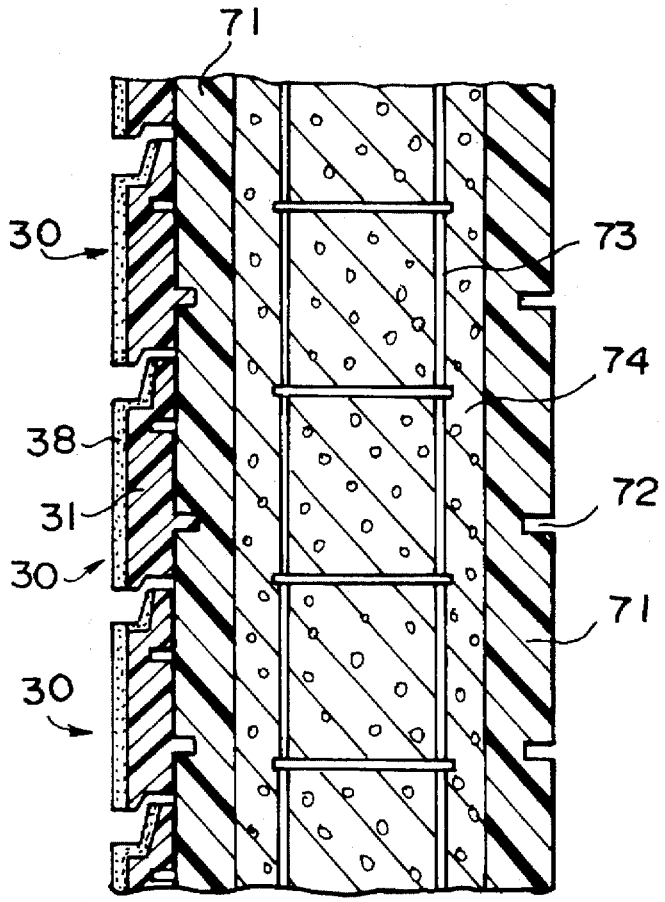
FIG. 7 is a cross-sectional view depicting the marble-tone decorative panel of FIG. 5, which is attached and spread onto a structural base (including a base panel) with an adhesive.

A plurality of rows of narrow attachment slot 72 or narrow attachment projection (not shown in the figure), which are formed at a predetermined interval in the vertical direction on structural base 71 (including a base panel) in its horizontal direction as an application structure as shown in FIG. 7, are attached into narrow attachment projection 35 or narrow attachment slot 36 of the waterproof lightweight marble-tone decorative panel 30 prior to adhesion with an adhesive. The structural base 71 (including a base panel) as the application structure can be readily and precisely attached even if the base is made of any material including a metal material, an inorganic material, a wood material, a synthetic resin material and the like.

The narrow attachment projection 35 formed on the back surface of the lightweight board 31 of the waterproof lightweight marble-tone decorative panel 30 may have a length in a range of 5 to 15 mm and a width in a range of 2 to 7 mm. Narrow attachment slot 36 if formed may have the same length (depth) and width as those of the narrow attachment projection 35. If the length and width of the slot are longer by 0.5 to 1.0 mm than those of the projection, however, the application of the decorative panel 30 may be done more readily with an adhesive.

Figure 8:
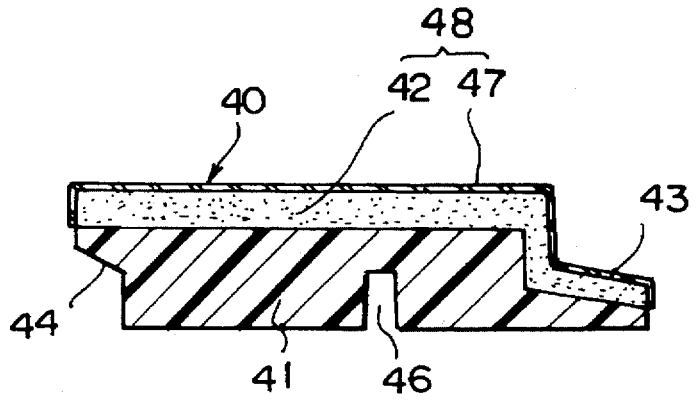
FIG. 8 is a cross-sectional view depicting a marble-tone decorative panel where the surface of a lightweight board cut into the shape and dimension of a tile is covered with a marble-tone paint layer and the back surface thereof has a narrow attachment slot formed thereon.

FIG. 8 depicts waterproof lightweight marble-tone decorative panel 40 formed with marble-tone paint layer 48 on the surface of lightweight board 41. The lightweight board 41 and the marble-tone paint layer 48 to be used therefor are the same as the lightweight board 31 and the marble-tone paint layer 38 of FIG. 5. In FIG. 8, narrow attachment slot 46 is formed on the back surface of the lightweight board 41 so as to promote the application of the decorative panel more readily and precisely.

Figure 9:
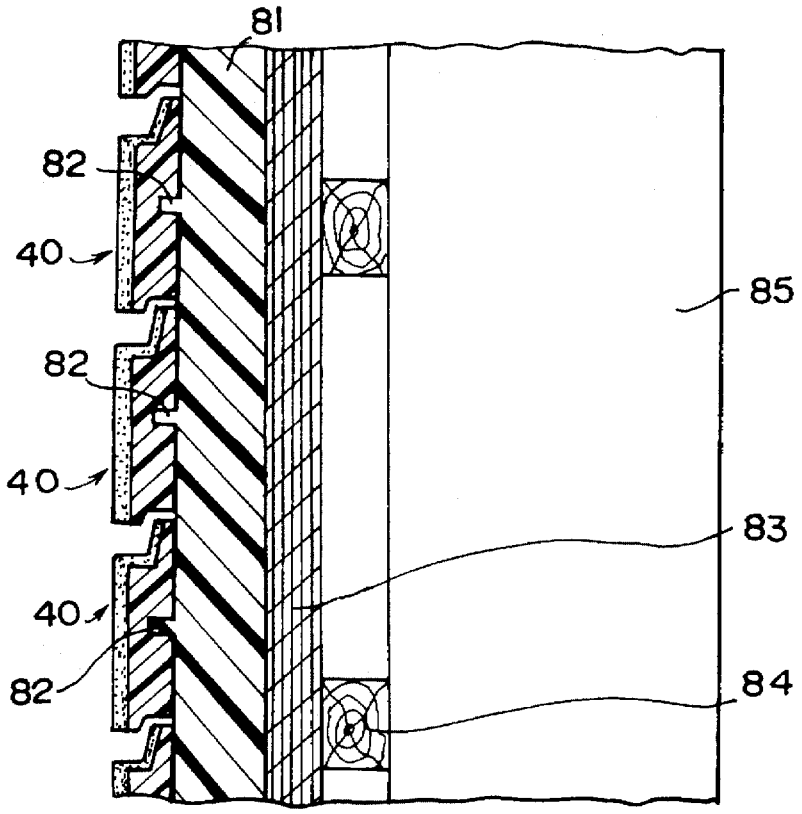
FIG. 9 is a cross-sectional view depicting the marble-tone decorative panel of FIG. 8, which is attached and spread onto a structural base (including a base panel) with an adhesive.

As shown in FIG. 9, narrow attachment projection 82 formed on structural base 81 (including a base panel) as the application structure is attached into narrow attachment slot 46 of the waterproof lightweight marble-tone decorative panel 40 prior to adhesion with an adhesive.

Figure 10:
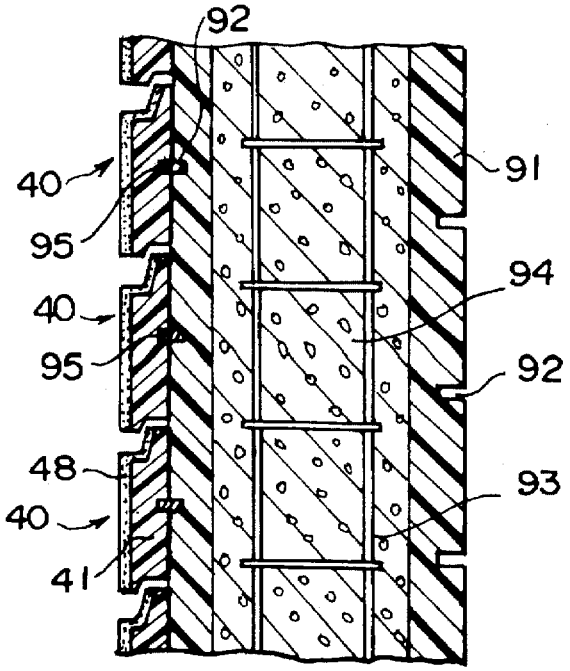
FIG. 10 is a cross-sectional view depicting the marble-tone decorative panel of FIG. 8, which is attached and spread through a narrow connection plate onto a structural base (including a base panel) with an adhesive.

As a means for applying the waterproof lightweight marble-tone decorative panel 40, forming narrow slot in recess 92 on structural base 91 (including a base panel) as the application structure and inserting and disposing narrow connection plate 95 through an adhesive between narrow attachment slot 46 formed on the back surface of lightweight board 41 and the narrow slot in recess 92, as shown in FIG. 10, the decorative panel 40 can be attached and spread on the structural base The narrow connection plate 95 is formed of any one of various materials including plastic plates, foaming plastic plates, wood plates, inorganic plates and the like. By the application means, even an unskilled person can carry out the application more readily, precisely and rapidly.

The present invention will be now described in examples, but the invention is not limited to these examples.

EXAMPLE 1

As shown in FIG. 1, waterproof grain-tone decorative panel 10 was produced by forming waterproof grain-tone layer 12 with a paint material on the surface of hard foaming plastic board 11 extrusion molded from polystyrene.

The paint material herein used was produced by sufficiently kneading together in a vacuum deaerated kneader a composition composed of 15% by weight of a synthetic rubber modified acrylate copolymer emulsion as a synthetic resin emulsion, 25.5% by weight of a micro-hollow fine ceramic particle, and 59.5% by weight of a crushed granite particle.

As the synthetic resin modified acrylate copolymer emulsion, use was made of an aqueous emulsion (solid content at 50% by weight) of a copolymer of acrylate and a synthetic rubber.

As the micro-hollow fine ceramic particle, use was made of a burned product comprising

40% by weight of alumina components and 60% by weight of silica components (and 1.5% by weight of other components), with the physico-chemical properties being a waterproof pressure strength of 700 kgf/cm$^2$, a bulk density of g/cm$^3$ and a melting point of 1600° C. The product is composed of totally porous particles alone. The micro-hollow fine ceramic particle was adjusted to have a particle size distribution of 20 parts by weight of fine particles, 20 parts by weight of medium particles and 30 parts by weight of coarse particles.

Furthermore, the crushed granite particle was adjusted to have a particle size distribution of 60% by weight of fine particles, 30% by weight of medium particles and 10% by weight of coarse particles.

By coating the thus obtained paint material on the surface and side of the 5-mm thick hard foaming plastic board of polystyrene at a thickness of about 1 mm by means of a roller, the board was coated and leaved to be dried and hardened.

As shown in FIG. 2, the resulting waterproof grain-tone decorative panel 10 was attached and spread onto concrete structure 51 with adhesive 52. Because the resulting waterproof grain-tone decorative panel 10 has a specific gravity of about 0.3 to 0.5, the panel can be readily attached and spread by means of the adhesive. Thus, the application thereof could be done even by an unskilled person. Furthermore, the panel has a great surface hardness due to the high strength of the micro-hollow fine ceramic particle with a waterproof pressure strength of 600 kgf/cm$^2$ or more, so the surface of the panel is hardly damaged. The thermal insulation property of the panel is excellent, because of the good thermal insulation of the micro-hollow fine ceramic particle. Thus, the panel can protect the structure against heat. Still furthermore, the panel has higher resistance against acid rain, with no concern against erosion.

EXAMPLE 2

As shown in FIG. 5, waterproof grain-tone decorative panel 30 was produced by forming marble-tone paint layer 38 with a paint material on the surface of hard forming plastic board 31 extrusion molded from polystyrene.

The paint material herein used was produced by sufficiently kneading together in a vacuum deaerated kneader a composition composed of 18% by weight of the synthetic rubber modified acrylate copolymer emulsion as in Example 1, 26.0% by weight of the micro-hollow fine ceramic particle as in Example 1, 43.5% by weight of the crushed granite particle as in Example 1, 5.0% by weight of an organic additive (dispersant and the like), 4.0% by weight of an inorganic pigment and 4.5% by weight of other substances.

Coating the thus obtained paint material on the surface of a hard foaming plastic board of polystyrene at a thickness of about 4 mm, thereafter hardening the coat layer at room temperature for 8 hours and subjecting the board to pressure molding at a press pressure of 200 kgf/cm$^2$ prior to hardening at room temperature for 24 hours, and thereafter buffing the board, the synthetic rubber modified acrylate copolymer emulsion as described above was coated as a topcoat onto the resulting board.

The thickness of the hard foaming plastic board was 12 mm, while half-lap joints 33, 34 were made on both the ends of the plastic board. Narrow attachment projection 35 on the back surface had a length of 7 mm and a width of 3 mm. As shown in FIG. 7, the resulting waterproof lightweight marble-tone decorative panel 30 was applied onto hard foaming plastic structural base 71. Herein, 73 represents reinforcing steel; and 74 represents concrete.

The waterproof lightweight marble-tone decorative panel 30 has marble-tone gloss and optical brightness. Additionally, the panel can improve the weathering resistance and protect the paint layer via the topcoat. Still additionally, the panel exerts far greater marble-tone gloss and optical brightness.

EXAMPLE 3

As shown in FIG. 8, waterproof lightweight marble-tone decorative panel 40 was produced on a base materials of a hard plastic board extrusion molded from polyvinyl chloride. The paint material used therein and the molding method ape the same as in Example 2. The hard plastic board has a thickness of 7 mm, while the narrow attachment slot 46 has a depth of 4 mm and a width of 3 mm. As shown in FIG. 9, the resulting waterproof lightweight marble-tone decorative panel 40 was applied onto the projection 82 formed on hard foaming plastic structural base 81 . Herein, 83 represents laminated wood; 84 represents furring strip; and 85 represents wood column.

What is claimed is:

1. A waterproof grain-tone decorative panel having a waterproof grain-tone paint layer formed on the surface of a lightweight board, said lightweight board having a specific gravity of not more than 1.0 and said paint layer comprising 15% to 40% by weight of micro-hollow fine ceramic particles, and 35% to 75% by weight of a crushed natural stone particle bound with a 5% to 20% by weight of synthetic resin waterproof binder, said micro-hollow fine ceramic particles being comprised of 35% to 45% by weight alumina components and 55% to 65% by weight silica compounds and having a melting point of 1500° C. or more and a waterproof pressure strength of 600 kgf/cm$^2$ or more.

2. A waterproof lightweight grain-tone decorative panel according to claim 1, wherein the board is selected from the group consisting of a plastic board, a mineral lightweight board, and a wood board.

3. A waterproof lightweight grain-tone decorative panel according to claim 1, wherein the lightweight board has a narrow attachment projection or an attachment slot on the back surface thereof.

* * * * *